US005265312A

United States Patent [19]

Okumura

[11] Patent Number: 5,265,312

[45] Date of Patent: Nov. 30, 1993

[54] HOOK DEVICE IN POWER DRIVEN TOOL

[75] Inventor: Michio Okumura, Anjo, Japan

[73] Assignee: Makita Corporation, Anjo, Japan

[21] Appl. No.: 953,875

[22] Filed: Sep. 30, 1992

[30] Foreign Application Priority Data

Oct. 7, 1991 [JP] Japan ..... 3-90602[U]

[51] Int. Cl.[5] ..... A45F 5/00

[52] U.S. Cl. ..... 24/3 L; 24/3 R; 24/3 J; 224/269

[58] Field of Search ..... 24/3 L, 3 R, 3 J, 335, 24/336; 224/904, 252, 269, 312

[56] References Cited

U.S. PATENT DOCUMENTS

| | | | |
|---|---|---|---|
| 668,088 | 2/1901 | Bruce | 24/3 R |
| 881,757 | 3/1908 | Winsor . | |
| 1,217,154 | 2/1917 | Colvin . | |
| 1,705,595 | 3/1929 | Traeger . | |
| 1,913,003 | 6/1933 | Shaff . | |
| 2,320,450 | 6/1943 | Valenzuela . | |
| 2,345,651 | 3/1944 | Jensen | 24/3 J |
| 2,418,410 | 4/1947 | Hull . | |
| 2,543,134 | 2/1951 | Smith et al. . | |
| 2,926,403 | 3/1960 | Weissman . | |
| 4,214,688 | 7/1980 | Griffin, Jr. | 224/269 |
| 4,363,432 | 12/1982 | Warthen | 24/3 L |
| 4,635,836 | 1/1987 | Mooney et al. | 224/269 |
| 4,887,753 | 12/1989 | Allen | 24/3 L |
| 4,897,898 | 2/1990 | Chapin | 24/3 L |

FOREIGN PATENT DOCUMENTS

| | | |
|---|---|---|
| 15-11905 | 8/1940 | Japan . |
| 24-37598 | 8/1949 | Japan . |
| 6127683 | 2/1956 | Japan . |
| 48-83481 | 10/1973 | Japan . |
| 52-12233 | 3/1977 | Japan . |
| 52-118470 | 9/1977 | Japan . |
| 58-154080 | 10/1983 | Japan . |
| 59-78087 | 5/1984 | Japan . |
| 64-23377 | 2/1989 | Japan . |
| 587049 | 4/1947 | United Kingdom . |

*Primary Examiner*—Victor N. Sakran

*Attorney, Agent, or Firm*—Dennison, Meserole, Pollack & Scheiner

[57] ABSTRACT

A hook device in a power driven tool includes a hook member having a base disposed along a mounting portion of the body of the power driven tool and having a hook portion extending from the base for engagement with an object such as a waist belt of an operator. The mounting portion of the body includes a pair of engaging slots spaced from each other in a circumferential direction of the mounting portion. The base of the hook member includes a pair of engaging members disposed at both ends of the base in a circumferential direction for engagement with the engaging slots, respectively.

12 Claims, 3 Drawing Sheets

HOOK DEVICE IN POWER DRIVEN TOOL

BACKGROUND OF THE INVENTION

1. Field of the Invention

The present invention relates to a hook device in a power driven tool.

2. Description of the Prior Art

In a power driven tool, a hook member is provided on the tool body for engagement with an object such as a waist belt of an operator.

Japanese Laid-Open Utility Model Publication No. 48-83481 discloses a power driven tool which includes a hook member integrally formed with the body of the power driven tool and also discloses a hook member mounted on the body by screws.

Japanese Laid-Open Utility Model Publication No. 59-78087 discloses a power driven tool which includes a hook member held between a gear cover and an inner cover of the tool body in such a manner that the hook member can be selectively mounted on either of right and left side of the body.

However, in case of the former power driven tool, the hook member cannot be conveniently used since its position cannot be varied.

In case of the latter power driven tool, the hook member can be positioned at either side of the body. However, since the hook member is held between the gear cover and the inner cover, the mounting operation of the hook member must be performed at the same time with assembling parts of the tool body including the gear cover and the inner cover, and the removing operation of the hook member must accompany a disassembling operation of the parts of the body. Therefore, the mounting and removing operations of the hook member are very troublesome. Additionally, the hook member cannot be held in a stable manner because of possible loosening of holding force between the gear cover and the inner cover.

SUMMARY OF THE INVENTION

It is, accordingly, an object of the present invention to provide a hook device in a power driven tool which permits a hook member to be easily and reliably mounted on or removed from the body of the power driven tool.

According to the present invention, there is provided a hook device in a power driven tool which includes a hook member having a base disposed along a mounting portion of the body of the power driven tool and having a hook portion extending from the base for engagement with an object such as a waist belt of an operator. The mounting portion of the body includes a pair of engaging slots spaced from each other in a circumferential direction of the mounting portion. The base of the hook member includes a pair of engaging members disposed at both ends of the base in a circumferential direction for engagement with the engaging slots, respectively.

The invention will become more fully apparent from the claims and the description as it proceeds in connection with the drawings.

DETAILED DESCRIPTION OF THE PREFERRED EMBODIMENTS

A first embodiment of the present invention will now be explained with reference to FIGS. 1 to 4.

Figure 1:
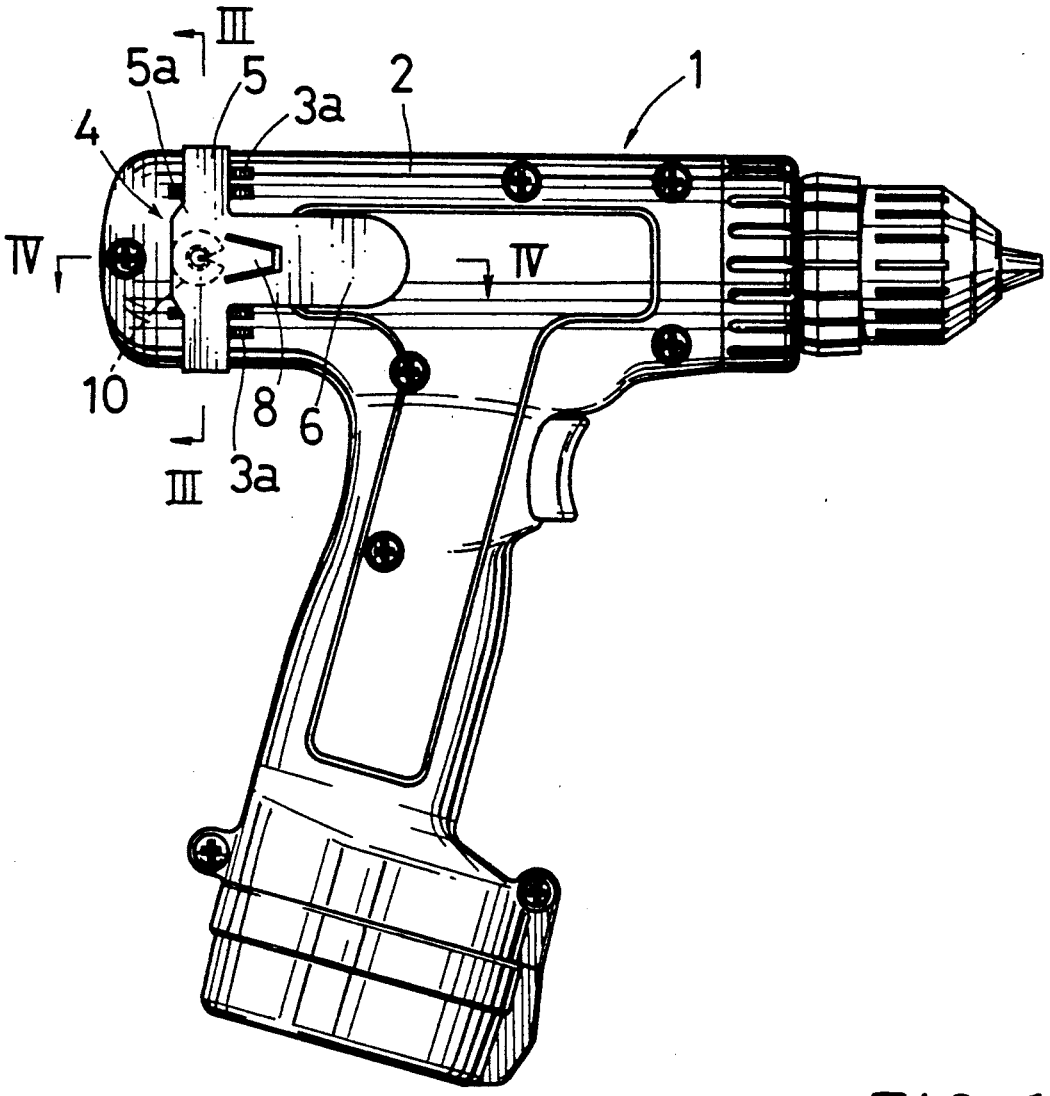
FIG. 1 is a side view of a power driven screwdriver including a hook device according to a first embodiment of the present invention.
Figure 2:
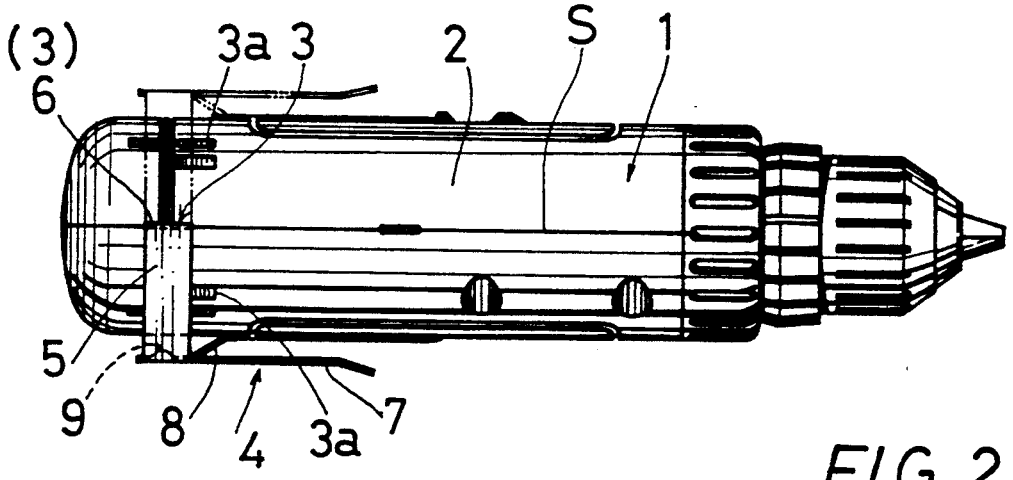
FIG. 2 is a plan view of FIG. 1.

Referring to FIG. 1, there is shown a power driven screwdriver 1 having a body 2. The upper portion of the body 2 is of substantially cylindrical configuration and includes a pair of slots 3 formed on the outer surface of its rear portion (left side as viewed in FIG. 1). The slots 3 extend in an axial direction of the upper portion of the body and are diametrically opposed to each other in a vertical direction. In case of this embodiment, the body 2 is separated into two parts by a separating surface S extending in a vertical direction, and the slots 3 are formed on the separating surface S. Such slots 3 are normally formed on this kind of the body 2 for compensation of assembling tolerance. The body 2 further includes a plurality of slots 3*a* symmetrically disposed about an axis of the upper portion for ventilation purpose.

A hook member 4 is made of a steel plate having relatively thin thickness and is resiliently deformable. The hook member 4 includes a base 5 curved along the outer surface of the upper portion of the body 2 and extends to cover substantially half the outer surface in a circumferential direction. The base 5 includes a flat portion 5*a* at the central portion. A pair of engaging members 6 are formed on both ends of the base 5 in the circumferential direction by bending the ends inwardly toward the body 2 at right angles. The engaging members 6 are detachably engageable with the corresponding slots 3 formed on the body 2. A substantially flat hook portion 7 extends from the flat portion 5*a* in an axial direction of the upper portion of the body 2 and has a predetermined width. A substantially trapezoidal abutting portion 8 extends obliquely from the flat portion 5*a* to abut on the outer surface of the upper portion of the body 2. The abutting portion 8 is formed by partly cutting the hook portion 7 and bending the cut portion inwardly.

The flat portion 5*a* of the base 5 includes a protrusion 9 which has substantially spherical configuration and extends downwardly from the flat portion 5*a*. The forward end of the hook portion 7 is slightly bent outwardly for ease of engagement with a waist belt (not shown) of an operator. Further the forward end of the abutting portion 8 is bent in the axial direction along the outer surface of the body 2.

The base 5, the engaging members 6, the hook portion 7 and the abutting portion 8 are integrally formed with each other by cutting and bending the steel plate.

A spacer 10 is made of synthetic resin and has substantially C-shaped configuration in plan view. A concave portion 10*a* is formed on the central portion of the spacer 10 for receiving the protrusion 9 of the base 5. The upper surface of a part of the spacer 10 positioned forwardly of the concave portion 10*a* is inclined downwardly. The spacer 10 is interposed between the flat portion 5*a* of the base 5 and the outer surface of the body 2 so as to keep the hook member 4 in position. Thus, the spacer 10 is inserted between the flat portion 5*a* and the outer surface of the body 2 after the engaging members 6 are engaged with the corresponding slots 3, respectively, in such a manner that the base 5 extends along the outer surface of the body 2 and that the abutting portion 8 abuts on the outer surface of the body 2. The spacer 10 therefore resiliently holds the hook member 4 so as to keep engagement of the engaging members 6 with the corresponding slots 3. The spacer 10 also serves to provide an appropriate resiliency to the hook portion 7.

The operation of the above embodiment will now be explained in connection with the mounting operation of the hook member 4.

Firstly, the base 5 of the hook member 4 is positioned along the outer surface of the body 2 at either the right or the left side of the body 2 in such a manner that the hook portion 7 extends in the axial direction of the upper portion of the body 2 and that the abutting portion 8 abuts on the outer surface of the upper portion of the body 2. The engaging members 6 of the base 5 are subsequently engaged with their corresponding slots 3 of the body 2, respectively. The engaging members 6 are kept in engagement with the slots 3 by the resilient force of the base 5 which urges the engaging members 6 toward the corresponding slots 3.

The spacer 10 is thereafter inserted between the flat portion 5*a* of the base 5 and the outer surface of the body 2 in such a manner that the concave portion 10*a* is brought to engage the protrusion 9 of the base 5 so as to keep the spacer 10 in position.

At this stage, the base 5 is forced outwardly by the spacer 10, so that the base 5 can be reliably positioned relative to the body 2. Further, the abutting member 8 cooperates with the spacer 10 to keep the hook member 4 in position. Thus, the abutting member 8 abuts on the body 2 at a position displaced from the spacer 10 in a forward direction, so that the hook member 4 is prevented from rattling movement around the engaging points between the engaging portions 6 and the slots 3.

The hook member 4 can be reliably engaged with the waist belt of the operator through the hook portion 7 having the appropriate resiliency, so that the power driven screwdriver 1 can be reliably held by the waist belt.

To remove the hook member 4 from the body 2 of the power driven screwdriver 1, the spacer 10 is removed between the flat portion 5*a* of the base 5 and the body 2 so as to disengage the concave portion 10*a* from the protrusion 9. The engaging members 6 are subsequently disengaged from the slots 3, so that the hook member 4 is removed from the body 2.

Figure 3:
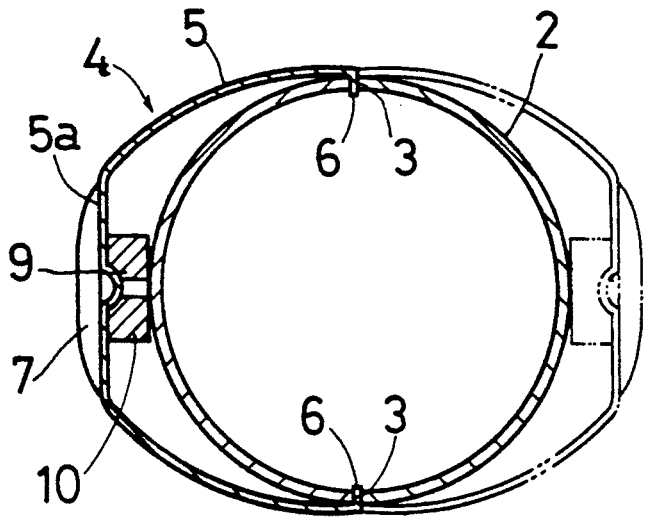
FIG. 3 is a sectional view taken along line III—III in FIG. 1.
Figure 4:
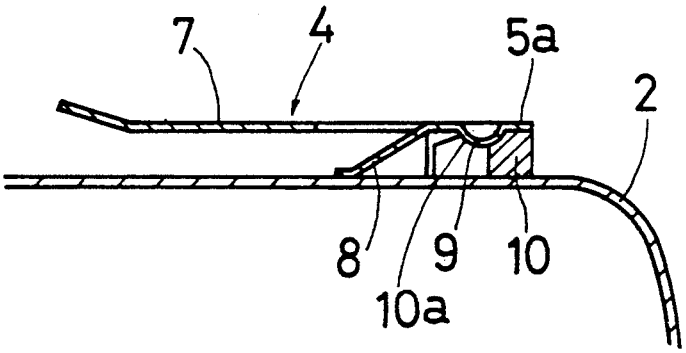
FIG. 4 is a sectional view taken along line IV—IV in FIG. 1.

In case that the hook member 4 is to be mounted on the other side of the body 2, the hook member 4 is disposed at a position displaced from the previous position by an angle of 180° as shown in FIG. 3, and is mounted on the body 2 in the same way as described above. Thus, the hook member 4 can be selectively mounted on either the right or the left side of the body 2 for convenience of the operator.

Figure 5:
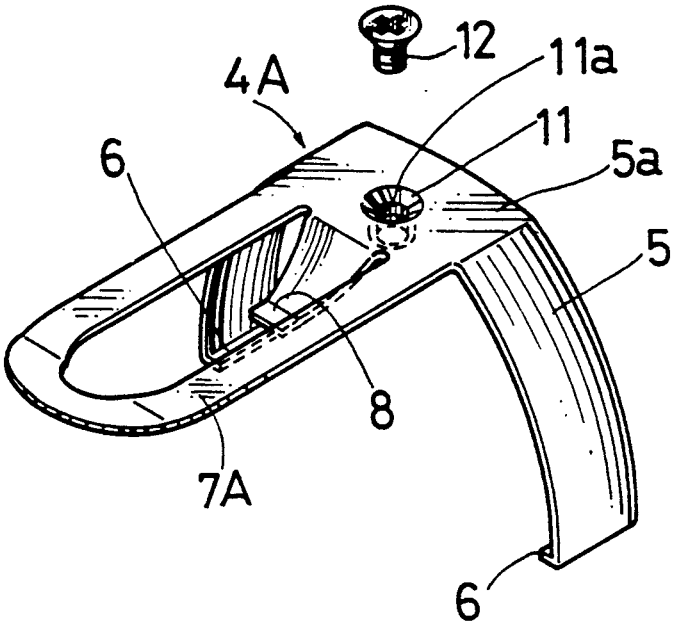
FIG. 5 is a perspective view of a hook device according to a second embodiment of the present invention.
Figure 6:
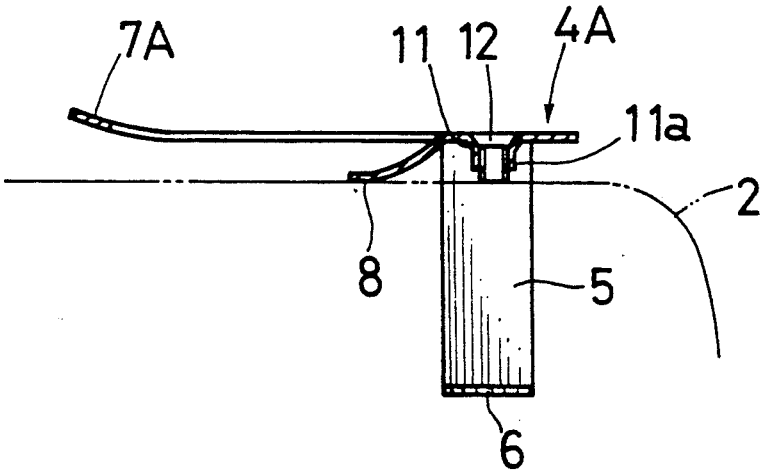
FIG. 6 is a vertical sectional view of a hook device shown in FIG. 5 in a condition mounted on the body of the power driven screwdriver.

A second embodiment of the present invention will now be explained with reference to FIGS. 5 and 6. The second embodiment is a modification of the first embodiment incorporating a screw in place of the spacer 10, and the construction other than that relating to the screw is the same as the first embodiment. Therefore, an explanation of the same construction is omitted by affixing to the drawing the same numerals as those of the first embodiment.

A funnel-shaped mounting portion 11 is integrally formed with a flat portion 5*a* of a base 5 of a hook member 4A and extends downwardly from the substantially the central portion of the flat portion 5*a*. The mounting portion 11 includes a threaded hole 11*a* on its cylindrical lower part for engagement with a countersunk screw 12. A hook member 7A has a longer opening than that of the hook member 7 of the first embodiment.

The operation of the second embodiment will now be explained.

Firstly, the base 5 of the hook member 4A is positioned along the outer surface of the body 2 at either the right or the left side of the body 2 in such a manner that the hook portion 7A extends in the axial direction of the upper portion of the body 2 and that the abutting portion 8 abuts on the outer surface of the upper portion of the body 2. The engaging members 6 of the base 5 are subsequently engaged with their corresponding slots 3 of the body 2, respectively.

These steps are the same as those of the first embodiment.

The countersunk screw 12 is thereafter engaged with the threaded hole 11*a* of the mounting portion 11 so as to bring its one end to abut on the body 2. The countersunk screw 12 is further tightened to move the base 5 in a direction away from the body 2 while the engaging members 6 are in engagement with the slots 3, respectively. Thus, the base 5 is forced outwardly by the spacer 10, so that the base 5 can be reliably positioned relative to the body 2.

To remove the hook member 4A from the body 2, the countersunk screw 12 is loosened, and thereafter the engaging members 6 are disengaged from the slots 3.

As described above, with the second embodiment, the mounting and removing operations of the hook member 4A can be easily made by tightening and loosening the countersunk screw 12. In other respect, the operation is the same as the first embodiment.

Although with the above embodiments, the engaging members 6 are engaged with the slots 3 formed on the separating surface S of the body 2, the slots 3*a* formed on the body 2 for ventilation purpose can be also used for engagement with the engaging members 6. In such a case, the mounting position of the hook member 4 is displaced to some extent in a circumferential direction from the mounting position in case that the slots 3 are used in the manner as described above.

Further, although the above embodiments have been described in connection with the hook device for use with the power driven screwdriver, the same structure is also applicable to any power driven tools other than the power driven screwdriver.

While the invention has been described with reference to preferred embodiments, it is to be understood that modifications or variation may be easily made without departing from the spirit of this invention which is defined by the appended claims.

What is claimed is:

1. A hook device in a power driven tool comprising:

a hook member having a base disposed along a mounting portion of the body of the power driven tool and having a hook portion extending from said base for engagement with an object such as a waist belt of an operator;

said mounting portion of said body including a pair of engaging slots spaced from each other in a circumferential direction of the mounting portion;

said base of said hook member including a central portion and a pair of engaging members disposed at both ends of the base in a circumferential direction for engagement with said engaging slots;

retainer means for urging said base of said hook member away from said body in a direction substantially perpendicular to the direction of engagement of said engaging members; and said retainer means is a spacer made of resilient material interposed between the central portion of said base and said mounting portion.

2. The hook device as defined in claim 1 wherein said mounting portion is of a cylindrical configuration and said engaging slots are opposed to each other in a diametrical direction of said mounting portion.

3. The hook device as defined in claim 1 wherein said base is formed by a spring plate which normally urges said engaging member toward said engaging slots, respectively after said hook member has been mounted on the body.

4. The hook device as defined in claim 1 wherein said mounting portion is laterally separated into two halves and said engaging slots are formed on a separating surface of said two halves.

5. A hook device in a power driven tool comprising:

a hook member having a base disposed along a mounting portion of the body of the power driven tool and having a hook portion extending from said base for engagement with an object such as a waist belt of an operator;

said mounting portion of said body including a pair of engaging slots spaced from each other in a circumferential direction of the mounting portion;

said base of said hook member including a central portion and a pair of engaging members disposed at both ends of the base in a circumferential direction for engagement with said engaging slots;

retainer means for urging said base of said hook member away from said body in a direction substantially perpendicular to the direction of engagement of said engaging members; and said retainer means is a screw engaged with substantially the central portion of said base in a direction toward said mounting portion in such a manner that said screw abuts on said body when tightened.

6. The hook device as defined in claim 5 wherein said mounting portion is of a cylindrical configuration and said engaging slots are opposed to each other in a diametrical direction of said mounting portion.

7. The hook device as defined in claim 5 wherein said base is formed by a spring plate which normally urges said engaging member toward said engaging slots, respectively after said hook member has been mounted on the body.

8. The hook device as defined in claim 5 wherein said mounting portion is laterally separated into two halves and said engaging slots are formed on a separating surface of said two halves.

9. A hook device in a power driven tool comprising:

a hook member having a base disposed along a mounting portion of the body of the power driven tool and having a hook portion extending from said base for engagement with an object such as a waist belt of an operator;

said mounting portion of said body including a pair of engaging slots spaced from each other in a circumferential direction of the mounting portion;

said base of said hook member including a flat central portion and a pair of engaging members disposed at both ends of said base in a circumferential direction for engagement with said engaging slots;

an abutting portion for resiliently abutting on said body; and retainer means for urging the base of said hook member away from the body in a direction substantially perpendicular to the direction of engagement of the engaging members, wherein said abutting portion cooperates with said retainer means for keeping the hook member in a mounting position.

10. The hook device as defined in claim 9 wherein said mounting portion is of a cylindrical configuration and said engaging slots are opposed to each other in a diametrical direction of said mounting portion.

11. The hook device as defined in claim 9 wherein said base is formed by a spring plate which normally urges said engaging member toward said engaging slots, respectively after said hook member has been mounted on the body.

12. The hook device as defined in claim 9 wherein said mounting portion is laterally separated into two halves and said engaging slots are formed on a separating surface of said two halves.

* * * * *